US012402711B2

(12) United States Patent
Berhault

(10) Patent No.: US 12,402,711 B2
(45) Date of Patent: Sep. 2, 2025

(54) APPLICATOR FOR APPLYING A PRODUCT, IN PARTICULAR A COSMETIC PRODUCT

(71) Applicant: L'Oreal, Paris (FR)

(72) Inventor: Alain Berhault, Clichy (FR)

(73) Assignee: L'Oreal, Paris (FR)

( * ) Notice: Subject to any disclaimer, the term of this patent is extended or adjusted under 35 U.S.C. 154(b) by 872 days.

(21) Appl. No.: 17/272,183

(22) PCT Filed: Aug. 29, 2019

(86) PCT No.: PCT/EP2019/073071
§ 371 (c)(1),
(2) Date: Feb. 26, 2021

(87) PCT Pub. No.: WO2020/043816
PCT Pub. Date: Mar. 5, 2020

(65) Prior Publication Data

US 2021/0307487 A1 Oct. 7, 2021

(30) Foreign Application Priority Data

Aug. 29, 2018 (FR) ..... 1857744

(51) Int. Cl.
*A45D 34/04* (2006.01)
*A45D 40/20* (2006.01)

(52) U.S. Cl.
CPC ..... *A45D 34/045* (2013.01); *A45D 40/20* (2013.01); *A45D 2200/1072* (2013.01)

(58) Field of Classification Search
CPC ..... A45D 34/045; A45D 40/265
See application file for complete search history.

(56) References Cited

U.S. PATENT DOCUMENTS

| | | | | |
|---|---|---|---|---|
| 2018/0344001 | A1* | 12/2018 | Tanaka | A45D 33/006 |
| 2019/0000212 | A1* | 1/2019 | Balestrini | A45D 34/043 |
| 2020/0367631 | A1* | 11/2020 | Bianco | A45D 40/265 |
| 2020/0383457 | A1* | 12/2020 | Park | A45D 40/265 |

FOREIGN PATENT DOCUMENTS

| | | | |
|---|---|---|---|
| EP | 1195105 | * | 4/2002 |
| EP | 1563759 | * | 8/2005 |
| FR | 2866215 | * | 8/2005 |

(Continued)

OTHER PUBLICATIONS

Machine Translation of FR 2866215; Available Aug. 2005.*

(Continued)

*Primary Examiner* — Rachel R Steitz
*Assistant Examiner* — Karim Asqiriba
(74) *Attorney, Agent, or Firm* — CHRISTENSEN O'CONNOR JOHNSON KINDNESS PLLC

(57) ABSTRACT

The applicator for applying a product, in particular a cosmetic product, comprises a gripping cap (50) and an applicator member (52) that is provided with at least one application surface for said product and comprises a flexible portion (53). The applicator also comprises a rigid assembly insert (54) that is mounted at least partially inside the gripping cap (50) and is secured to said cap. The flexible portion (53) of the applicator member is fastened in the assembly insert (54) in a region of said insert which is mounted inside the gripping cap (50).

20 Claims, 3 Drawing Sheets

(56) References Cited

FOREIGN PATENT DOCUMENTS

Figure 1:
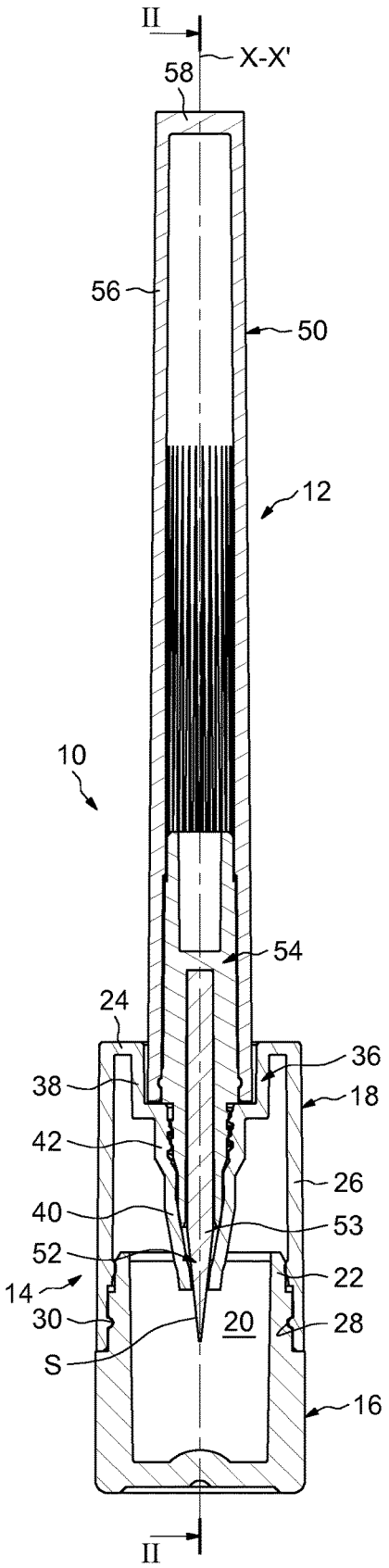

| | | | | |
|---|---|---|---|---|
| JP | 2008-006267 | A | | 1/2008 |
| JP | 20086267 | | * | 1/2008 |
| JP | 2009-034145 | A | | 2/2009 |

OTHER PUBLICATIONS

Espacenet Machine Translation of EP 1563759; Available Aug. 2005.*
Espacenet Machine Translation of JP 20086267; Available Jan. 2008.*
Machine Translation of EP 1195105; Available Apr. 2002.*

* cited by examiner

APPLICATOR FOR APPLYING A PRODUCT, IN PARTICULAR A COSMETIC PRODUCT

The present invention relates to an applicator for applying a product, in particular a cosmetic product.

The expression "cosmetic product" is understood to mean a product as defined in Regulation (EC) No 1223/2009 of the European Parliament and of the Council of 30 Nov. 2009 relating to cosmetic products.

The invention is particularly designed for the application of a cosmetic product, such as a makeup product, for example an eyeliner in particular for drawing a line on the eyelids, or mascara to be applied to the eyelashes or eyebrows.

For the application of these types of product, use is conventionally made of an applicator of the type comprising a gripping cap, a protruding stem secured to the cap, and an applicator member fastened to the free end of the stem. The applicator member may for example be in the form of an applicator tip for applying an eyeliner, or in the form of a brush or comb attached to the stem for applying mascara. For more details on the design of such an applicator, reference may be made for example to the Patent Application WO-A2-2011/004341.

With this type of applicator, it may be difficult to obtain precise application of the product, in particular when it is an eyeliner to be deposited in the form of a line, given the significant axial distance between the free end of the applicator member and the gripping cap. Moreover, this does not make it possible to obtain entirely satisfactory use ergonomics.

The present invention aims to overcome these drawbacks.

An object of the invention is an applicator for applying a product, in particular a cosmetic product, comprising a gripping cap and an applicator member that is provided with at least one application surface for said product and comprises a flexible portion.

According to a first general feature, the applicator also comprises a rigid assembly insert that is mounted at least partially inside the gripping cap and is secured to said cap.

According to a second general feature, the flexible portion of the applicator member is fastened in the assembly insert in a region of said insert which is mounted inside the gripping cap.

In contrast to "rigid assembly insert", a "flexible portion of the applicator member" is understood to be a portion of the applicator member that is capable, on account of the material used and/or the dimensioning thereof, of deforming under the action of a load exerted by the user following contact with the surface to be treated, and of returning by elasticity to its initial position once the load ceases.

Fastening the flexible portion of the applicator member in a region of the assembly insert that is disposed axially inside the gripping cap makes it possible to reduce the axial distance between this cap and the free end of the applicator member.

Thus, the gripping region of the cap is closer to the applicator member compared with prior art applicators. This encourages good use ergonomics and improved precision of application. The overall axial size of the applicator is also reduced.

Moreover, the fastening region(s) between the assembly insert and the flexible portion of the applicator member that may be visible at the outer surface of said insert are concealed by the presence of the gripping cap around this or these fastening region(s). This contributes towards the appearance and the perceived quality of the applicator to the user.

Furthermore, the flexibility of the flexible portion of the applicator member allows it to deform, for example by bending, reversibly and thereby to provide a degree of comfort during application.

According to one advantageous provision, the flexible portion of the applicator member is fastened in the assembly insert by local plastic deformation of said insert.

The rigid nature of the assembly insert makes it possible to secure it to the flexible portion of the applicator member in a simple, safe and economic manner. The local plastic deformation(s) can be obtained for example by material creep, for example by crimping or by heading. Alternatively, it is possible to join the flexible portion of the applicator member to the assembly insert by other methods, for example by ultrasonic welding.

Preferably, the flexible portion of the applicator member is made of flexible material and the assembly insert is made of rigid material.

According to one particular provision, the Shore D hardness of the assembly insert may be greater than the Shore D hardness of the flexible portion of the applicator member by at least 20 units of hardness. The Shore D hardness of the flexible portion of the applicator member may for example be less than 60 and greater than 20.

According to one particular design, the gripping cap, the assembly insert and the applicator member may be designed such that the diameter D of the free end of said cap is between 8 mm and 12 mm and the axial length L between the free end of said cap and the free end of the applicator member is between 10 mm and 25 mm, with in particular an L/D ratio of between 0.83 and 3.13.

This particular design aims to make it easier to hold the gripping cap in the hand and to optimize the axial distance between the cap and the free end of the applicator member.

The assembly insert is preferably provided with a housing, inside which the flexible portion of the applicator member is mounted and fastened.

Advantageously, the assembly insert comprises at least one thread for making it possible to fasten said applicator to a container. The thread may be helical in order to allow fastening by screwing. Alternatively, it is possible to provide on the assembly insert one or more reliefs that make it possible to fasten it to the container by snap-fitting or snap-fastening. In this case, each relief forms coupling or clip-fastening teeth.

Thus, the applicator is fastened to the container by the assembly insert and not by the gripping cap as is the case in the prior art applicators.

In order to axially secure the gripping cap relative to the assembly insert, the latter may comprise at least one retaining member that engages with at least one complementary retaining member on the gripping cap.

In one embodiment, the applicator member comprises an applicator tip that forms said flexible portion and defines said product application surface. In an alternative embodiment, the applicator member may comprise a stem that forms said flexible portion and a plurality of application elements that are carried by the stem and each define a product application surface.

The invention also relates to a device for packaging and applying a product, in particular a cosmetic product, comprising a container for storing said product, and an applicator as defined above that is mounted in a removable manner between a closing position in which the assembly insert seals off the storage container and the applicator member is situated inside said container, being at least partially in contact with the product contained therein, and an application position in which the applicator is separated from said container.

In one embodiment, the storage container comprises a body and a collar which is fastened to the neck of the body and on which the assembly insert of the applicator is mounted in a removable manner. The collar may comprise an internal skirt, inside which the assembly insert and an end portion of the gripping cap of the applicator are fitted when the latter is in the position closing the storage container. This internal skirt may for example be provided with a fastening portion comprising at least one thread designed to engage with a thread of the assembly insert, and with a sealing portion in sealing contact with said insert, when the applicator is in the position closing the storage container.

In another embodiment, the assembly insert of the applicator is fastened to the neck of the storage container.

Figure 2:
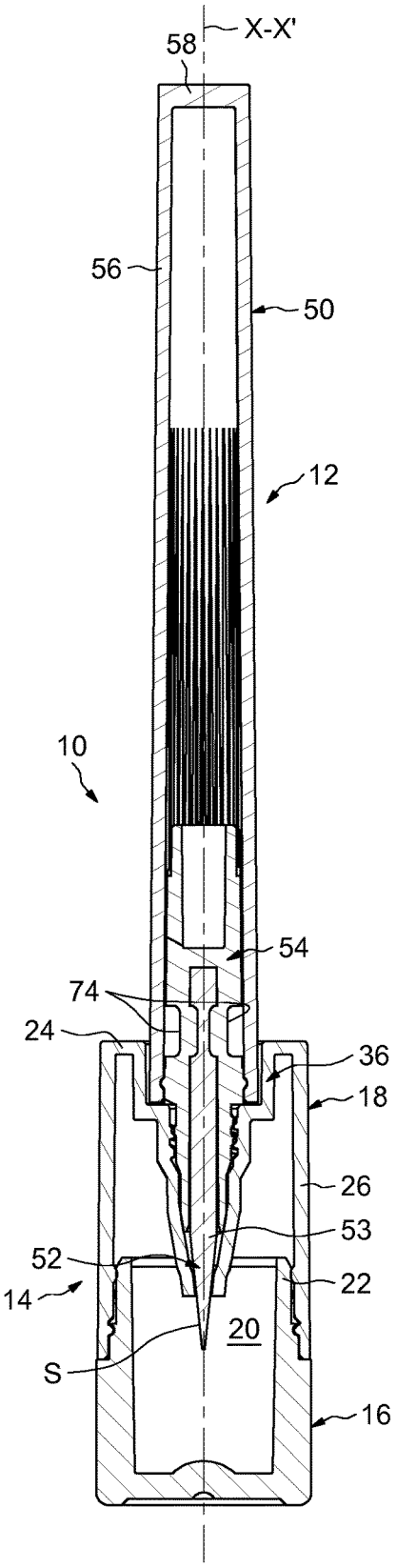
Figure 3:
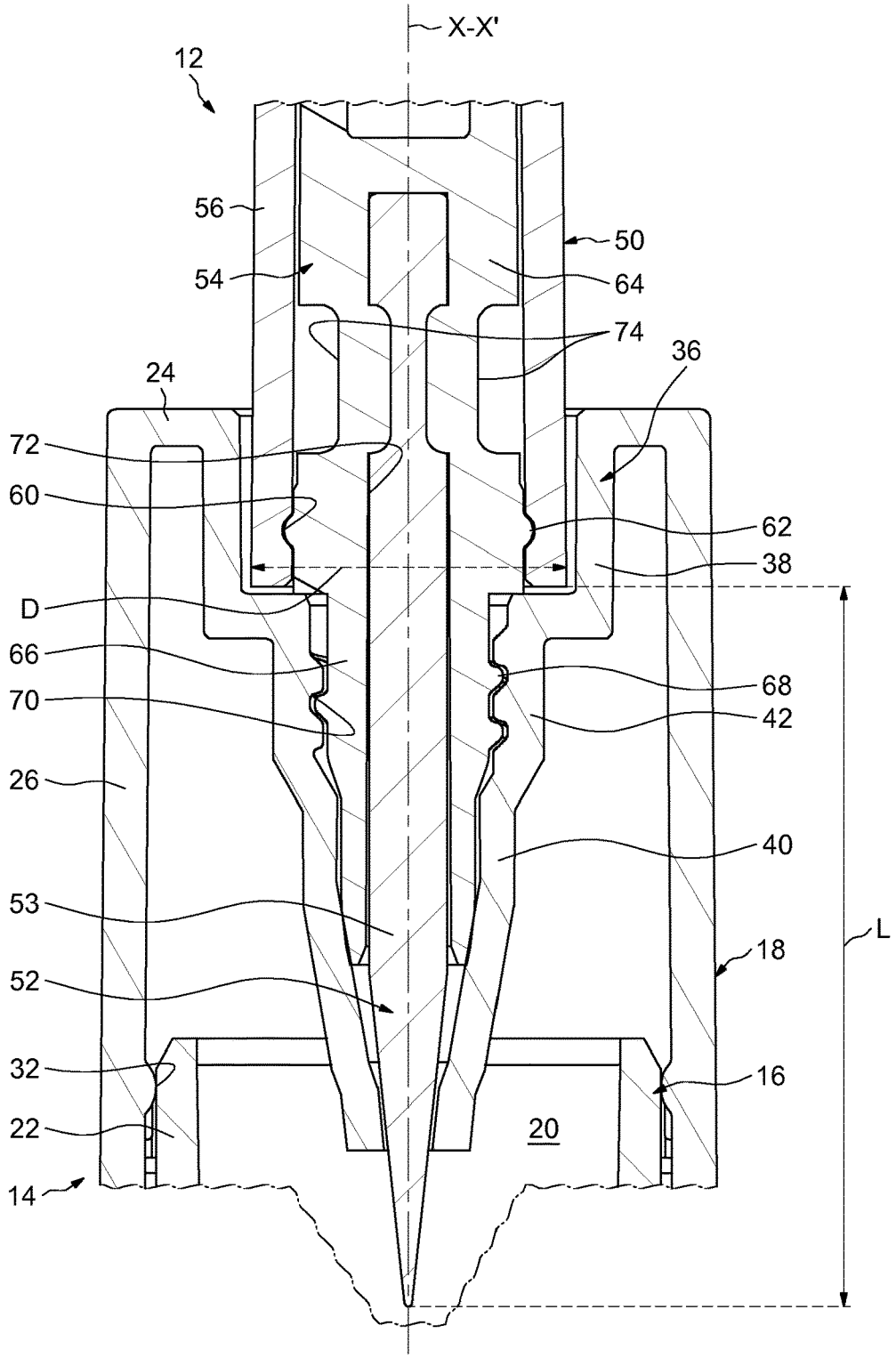
Figure 4:
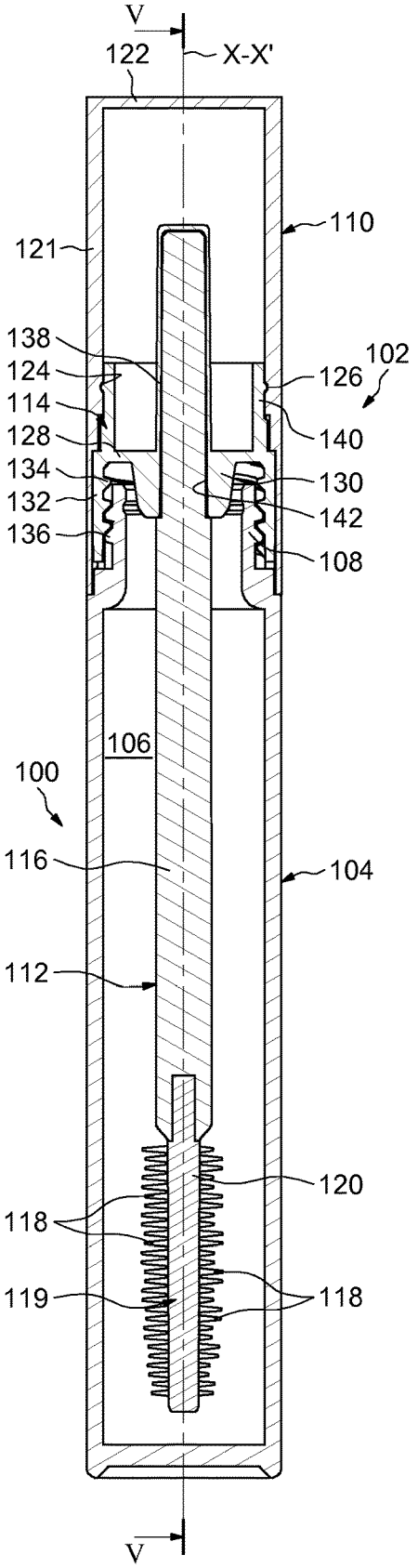
Figure 5:
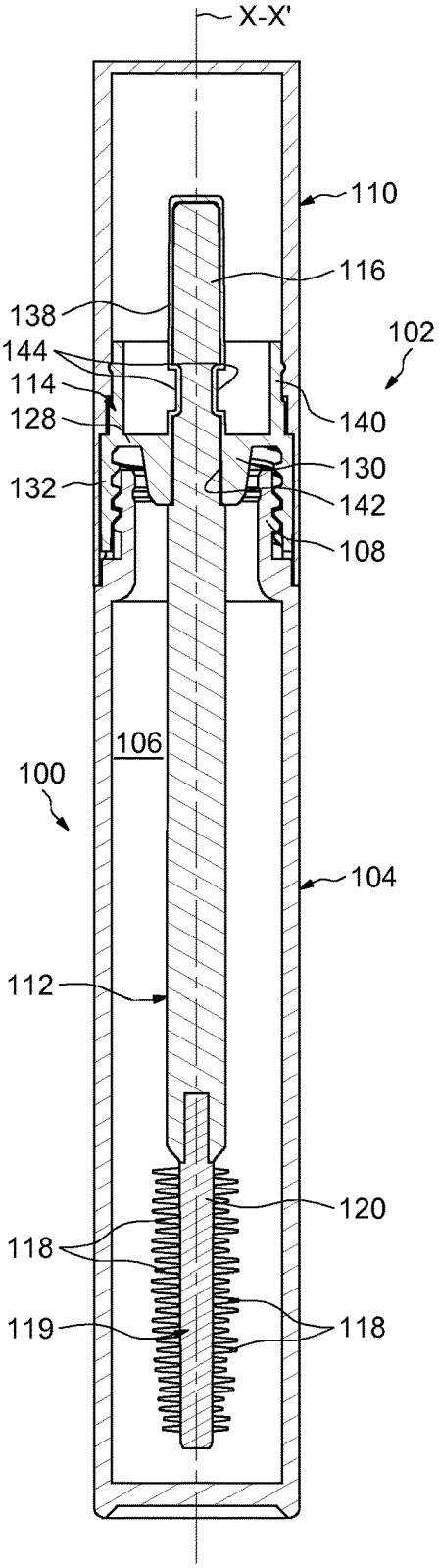

The present invention will be understood better from studying the detailed description of embodiments that are given by way of entirely non-limiting example and are illustrated by the appended drawings, in which:

FIG. 1 is a view in longitudinal section of a packaging and application device comprising an applicator according to a first exemplary embodiment of the invention, FIG. 2 is a view in cross section on the axis II-II in FIG. 1, FIG. 3 is a detail view of FIG. 2, FIG. 4 is a view in longitudinal section of a packaging and application device comprising an applicator according to a second exemplary embodiment of the invention, and FIG. 5 is a view in cross section on the axis V-V in FIG. 4.

FIGS. 1 and 2 show a device, denoted by the overall reference numeral 10, which is intended to allow the packaging and application of a cosmetic product. The cosmetic product to be applied may be for example an eyeliner.

The device 10, of longitudinal axis X-X', is shown in a position that is presumed to be vertical. The device 10 comprises a product applicator 12 and a container 14 containing the cosmetic product to be applied (not shown).

As will be described in more detail below, the applicator 12 is designed to achieve in particular a good degree of comfort during application of the product and improved precision of application.

In the exemplary embodiment illustrated, the container 14 comprises a body 16, of axis X-X', and a collar 18 fastened to the body. The body 16 internally delimits an internal volume or reservoir 20 for storing the cosmetic product. The body 16 comprises an end forming a bottom and an open opposite end forming a neck 22 that delimits an opening for accessing the internal reservoir 20. In the exemplary embodiment illustrated, the body 16 has a circular cross section. In a variant, the body 16 may have a cross section that is polygonal, in particular square, or an oval cross section. The body 16 is made in one piece by moulding a synthetic material. Alternatively, the body may be made of other materials, for example of glass. With such a material, a seal may be provided between the body 16 and the collar 18.

The collar 18 makes it possible in particular to removably mount the applicator 12 on the container 14. The collar 18 is likewise made in one piece by moulding a synthetic material. The collar 18 comprises an upper frontal end wall 24 and a peripheral external fastening skirt 26 extending said wall so as to allow the collar to be fastened to the body 16. The fastening skirt 26 is centred on the axis X-X'. The fastening skirt 26 extends axially from the end wall 24. The end wall 24 extends radially. The fastening skirt 26 axially continues a large-diameter edge of the end wall 24. The skirt 26 has a circular cross section.

The fastening skirt 26 of the collar comprises, on its inner surface, a bulge 28 for retaining the body 16 that extends inwards and engages by snap-fastening in a corresponding groove 30 formed in the outer surface of the neck 22 of said body. The bulge 28 may be continuous or discontinuous in the circumferential direction. As illustrated more clearly in FIG. 3, the fastening skirt 26 also comprises, on its inner surface, an annular sealing rib 32 that extends inwards. The rib 32 bears in a sealing manner against the neck 22 of the body. The rib 32 is situated axially above the snap-25 fastening bulge 28.

The fastening skirt 26 may also comprise, on its inner surface, a plurality of axial fins that are spaced apart from one another in the circumferential direction and engage with fins provided on the body 16 in order to provide an anti-rotation function preventing the collar 18 from rotating relative to said body.

The collar 18 comprises an internal annular mounting skirt 36 for accommodating the applicator 12 on and fastening it to the container 14, as will be described in more detail below. The mounting skirt 36 extends axially from the frontal end wall 24. The skirt 36 is centred on the axis X-X'. The external fastening skirt 26 radially surrounds the internal mounting skirt 36, remaining radially at a distance therefrom.

The internal mounting skirt 36 has a stepped shape. The internal skirt 36 is provided with a proximal mounting portion 38 extending from the frontal end wall 24, with a distal sealing portion 40 and with a fastening portion 42 extending between said mounting portion 38 and sealing portion 40. The fastening portion 42 has a smaller outside diameter than the outside diameter of the mounting portion 38, thereby leaving a radial shoulder (not referenced) therebetween. The sealing portion 40 axially continues the fastening portion 42 on the opposite side from the mounting portion 38. In the exemplary embodiment illustrated, the sealing portion 40 has an upwardly diverging conical part.

Referring again to FIGS. 1 and 2, the applicator 12 comprises a gripping cap 50, an applicator member 52 made in this case in the form of an applicator tip 53, and an assembly insert 54 that is fastened to the cap 50 and bears the applicator tip 53. The insert 54 is separate from the cap 50 and connected thereto. The insert 54 is secured to the cap 50. The insert 54 is also separate from the applicator member 52.

The applicator tip 53 is made of flexible material, in particular of flexible synthetic material. The applicator tip 53 may be for example a foam, a felt, a rubber, or a flocked body. The free end part of the applicator tip 53 defines a product application surface S that is intended to come into contact with the area of the user's body to be treated. The application surface S has in this case a frustoconical shape so as to promote the precision of application of the product. Alternatively, however, it remains possible to provide other shapes.

The cap 50, of axis X-X', comprises a tubular peripheral wall 56 and an upper frontal end wall 58 from which the wall 56 extends. In the exemplary embodiment illustrated, the peripheral wall 56 has a circular cross section. In a variant, the peripheral wall 56 may have a cross section that is polygonal, in particular square, or an oval cross section.

In order to fasten the cap 50 to the insert 54, the peripheral wall 56 of said cap comprises, on its inner surface, a groove 60 in which a retaining bulge 62 formed on the outer surface of the insert 54 engages by snap-fastening, as is illustrated more clearly in FIG. 3. The bulge 62 extends radially outwards. The bulge 62 may be continuous or discontinuous in the circumferential direction.

The insert 54 is made of rigid material. The insert may be made for example of rigid synthetic material, for example of PP, PE, etc., or of steel or aluminium.

In the exemplary embodiment illustrated, the insert 54 is mounted partially inside the cap 50 and protrudes axially out of said cap. The insert 54 comprises a proximal fastening portion 64 and a distal mounting portion 66. The fastening portion 64 makes it possible to fasten the cap 50 to the insert 54 and to fasten the applicator tip 53 inside said insert. The mounting portion 66 makes it possible to removably mount the applicator 12 on the container 14.

The fastening portion 64 of the insert is equipped, on its outer surface, with the bulge 62 for fastening the cap 50 to the insert. The fastening portion 64 is mounted inside the cap 50, and more specifically inside the peripheral wall 56 of said cap. The cap 50 covers the fastening portion 64 of the insert. The cap 50 is mounted on the insert 54 simply by being pushed axially. To make this mounting easier, a slight radial clearance may be provided between the outer surface of the fastening portion 64 of the insert and the inner surface of the peripheral wall 56 of the cap.

The mounting portion 66 of the insert axially continues the fastening portion 64. The mounting portion 66 protrudes axially out of the cap 50. The mounting portion 66 has a smaller outside diameter than the outside diameter of the fastening portion 64. A radial shoulder (not referenced) is formed between these portions and in this case comes to bear axially against the radial shoulder formed on the skirt 36 of the collar 18 of the container. The end part of the cap 50 that covers the insert 54 extends partially inside the mounting portion 38 of the skirt.

The mounting portion 66 of the insert comprises, on its outer surface, a helical thread 68 engaged with a corresponding thread 70 formed on the skirt 36 of the collar 18 of the container for screwing the applicator 12 to the container 14. The thread 70 is provided on the inner surface of the fastening portion 42 of the skirt. The threads 68, 70 may be continuous or discontinuous in the circumferential direction. The mounting portion 66 comes into sealing contact in the radial direction with the sealing portion 40 of the skirt 36 when the applicator 12 is in the position closing the container 14.

The insert 54 comprises a housing 72 inside which the applicator tip 53 is mounted and fastened. The housing 72 extends axially from the free end of the mounting portion 66 to the fastening portion 64. The housing 72 is centred on the axis X-X'. The housing 72 is made in this case in the form of a blind hole. The applicator tip 53 protrudes axially out of the insert 54. The applicator tip 53 thus protrudes out of the housing 72. The applicator tip 53 extends without contact inside the sealing portion 40 of the skirt 36 of the collar 18. The applicator tip 53 protrudes axially out of said sealing portion 40.

The applicator tip 53 is fastened inside the insert by local plastic deformations of the insert. These deformations, referenced 74, of the insert are visible in FIGS. 2 and 3. The local plastic deformations 74 are realized on the fastening portion 64 of the insert in the region of the housing 72. The deformations 74 are formed by material being embossed radially without chips being removed so as to locally bring about material creep radially towards the inside against the applicator tip 53. The flexible applicator tip 53 is also locally deformed. The applicator tip 53 is thus fastened inside the housing 72. This operation may be realized for example by crimping or by heading, and is carried out before the cap 50 is mounted on the insert 54.

In the closing position illustrated in the figures, in which the applicator 12 is mounted on the container 14, the insert 54 closes off the collar 18 of the container and the applicator tip 53 is situated inside the internal reservoir 20 of said container such that it can be filled, for example by contact or by capillarity, with product to be applied. When the user wishes to apply the product, they take hold of the cap 50 of the applicator 12, unscrew the insert 54 by rotating the cap, then handle said cap to obtain the desired application.

Given that the applicator tip 53 is fastened to a part of the insert 54 that is covered by the cap 50, this cap can be gripped by the user at a small axial distance from the free end of the applicator tip 53. This favours the ergonomics of use and also allows good precision of application. The flexibility of the applicator tip 53 also provides a degree of comfort during application and makes this application easier.

Advantageously, the diameter D of the free end of the cap 50 is between 8 mm and 12 mm and the axial length L between the free end of the cap 50 and the free end of the applicator tip 53 is between 10 mm and 25 mm, with in particular an L/D ratio of between 0.83 and 3.13.

With such an L/D ratio, the user has an applicator 10 of which the cap 50 has a diameter that makes it easier to grip, and having an applicator tip 53 end situated as close as possible to the gripping part of the cap in order to further improve the ergonomics and the precision of application.

In this first exemplary embodiment, the applicator of the device 10 is provided to apply a cosmetic product of the eyeliner type. It is possible to provide for the applicator that is the subject of the invention to be used to apply other types of cosmetic product.

For example, in the exemplary embodiment illustrated in FIGS. 4 and 5, the device 100 is intended to allow the packaging and application of a cosmetic product of the mascara type.

The device 100, of longitudinal axis X-X', comprises a product applicator 102 and a container 104 containing the cosmetic product to be applied (not shown).

In this exemplary embodiment, the container 104 is made in one piece. The container 104 internally delimits an internal volume or reservoir 106 for storing the cosmetic product. The container 104 comprises an end forming a bottom and an open opposite end forming a neck 108 that delimits an opening for accessing the internal reservoir 106.

The applicator 102 comprises a gripping cap 110, an applicator member 112, and an assembly insert 114 that is fastened to the cap 110 and bears the applicator member 112. The insert 114 is separate from the cap 110 and connected thereto. The insert 114 is secured to the cap 110. The insert 114 is also separate from the applicator member 112.

The applicator member 112 comprises a stem 116 extending along the axis X-X' and a plurality of application elements 118 borne by the stem 116. The applicator member 112 comprises an applicator end piece 119 that is fastened to the stem 116 and comprises the application elements 118. The application elements 118 are borne by the stem 116 via the applicator end piece 119. The application elements 118 protrude from the applicator end piece 119.

Each application element 118 defines a product application surface intended to come into contact with the user's keratin fibres, in this case the eyelashes and/or eyebrows.

The stem 116 is made of flexible material, in particular of flexible synthetic material. By way of indication, the stem 116 may for example be made of a flexible synthetic material such as SEBS, a silicone, latex, butyl, EPDM, a nitrile, a thermoplastic elastomer, etc. The stem 116 in this case has a circular cross section. In a variant, the stem 116 may have a cross section that is polygonal, in particular square, or an oval cross section, etc.

The application elements 118 are mounted on the applicator end piece 119. The application elements 118 have a function of separating and combing the user's keratin fibres, and delimit spaces between one another for these fibres to pass through. Each application element 118 extends radially outwards from the applicator end piece 119.

The application elements 118 are produced in this case in the form of spikes. The application elements 118 may have other forms, for example bristles, and/or teeth, and/or points, and/or striations, and/or bosses, and/or fins, etc. By way of indication, the height of the application elements 118 may be between 1 and 6 mm. The application elements 118 may have an equal height or have a height that varies along the axis X-X'. It is also possible to provide application elements that differ from one another by way of at least one of their shape, thickness, height, orientation, colour and/or material.

The applicator end piece 119 and the application elements 118 may for example be moulded from one and the same synthetic material, or in a variant they can be made from at least two different synthetic materials. The application elements 118 may for example be produced in one piece by moulding together with the applicator end piece 119 or by being overmoulded on said stem, or be fastened to the stem by any appropriate means, for example by adhesive bonding, flocking, crimping, etc.

The applicator end piece 119, of axis X-X', is mounted at the free end of the stem 116. To this end, a blind cutout (not referenced) is made in the lower end of the stem 116, inside which the applicator end piece 119 is partially accommodated. The applicator end piece 119 may be fastened to the stem 116 by any appropriate means, for example by wedging, screw fastening, welding, adhesive bonding, crimping, etc. The applicator end piece 119 comprises a core 120 of elongate shape, of axis X-X', on which the application elements 118 are disposed.

The cap 110, of axis X-X', comprises a tubular peripheral wall 121 and an upper frontal end wall 122 from which the wall 121 extends. In order to fasten the cap 110 to the insert 114, the peripheral wall 112 of said cap comprises, on its inner surface, a groove 124 in which a retaining bulge 126 formed on the outer surface of the insert 114 engages by snap-fastening. The bulge 126 extends radially outwards. The bulge 126 may be continuous or discontinuous in the circumferential direction.

The insert 114 is made of rigid material. The insert may be made for example of rigid synthetic material, for example of PP, PE, etc., or of steel or aluminium. In this illustrated exemplary embodiment, the insert 114 is mounted entirely inside the cap 110.

The insert 114 comprises an upper frontal end wall 128, a first internal mounting skirt 130 and a first peripheral external fastening skirt 132 surrounding the internal skirt. The skirts 130, 132 are centred on the axis X-X'. The skirts 130, 132 extend axially from the frontal wall 128. The frontal wall 128 extends radially.

The external skirt 132 axially continues a large-diameter edge of the frontal wall 128. The external skirt 132 radially surrounds the internal skirt 130, remaining radially at a distance from the latter. The external skirt 132 in this case extends axially beyond the internal skirt 130. The skirt 132 has a circular cross section.

The external skirt 132 internally comprises a helical thread 134 for screwing the insert 114 onto a corresponding thread 136 formed on the neck 108 of the container. The threads 134, 136 may be continuous or discontinuous in the circumferential direction.

The insert 114 also comprises a second internal mounting skirt 138 and a second peripheral external fastening skirt 140 surrounding the internal skirt, remaining radially at a distance therefrom. The skirts 138, 140 extend axially from the frontal wall 128 on the opposite side from the skirts 130, 132. The skirts 138, 140 are centred on the axis X-X'.

The external fastening skirt 140 is equipped, on its outer surface, with the bulge 126 for fastening the cap 110 to the insert 114. The mounting skirt 138 is situated in the axial continuation of the mounting skirt 130.

The insert 114 comprises a housing 142 which is delimited by the mounting skirts 130, 138 and inside which the stem 116 of the applicator member 112 is mounted and fastened. The housing 142 extends axially from the free end of the skirt 130 to a bottom wall of the skirt 138.

In a similar manner to the first example, the stem 116 is fastened inside the insert 114 by local plastic deformations of the insert. These deformations, referenced 144, of the insert are visible in FIG. 5. The local plastic deformations 144 are realized on the mounting skirt 138. The flexible stem 116 of the applicator member 112 is also deformed locally. The stem 116 is fastened inside the housing 142. The fastening may be realized for example by crimping or by heading, and is carried out before the cap 110 is mounted on the insert 114.

By virtue of the invention, an applicator is provided that has a limited axial size and good use ergonomics while making it possible to achieve improved precision of application.

The invention claimed is:

1. An applicator for applying a product, comprising a gripping cap, an applicator member that is provided with at least one application surface for said product and comprises a flexible portion, and a rigid assembly insert that is mounted at least partially inside the gripping cap and is secured to said cap, wherein the assembly insert comprises at least one fastening element that is able to allow said applicator to be fastened to a container, wherein the gripping cap is mounted on an outer surface of the assembly insert, wherein the flexible portion of the applicator member is fastened in the assembly insert in a region of said insert that is mounted inside the gripping cap, wherein the flexible portion of the applicator member is fastened in the assembly insert by local plastic deformations of the outer surface of said insert which extend radially against the flexible portion of the applicator member, wherein said local plastic deformations are visible at the outer surface of the assembly insert and concealed by the gripping cap, wherein the assembly insert comprises a first portion, a second portion comprising the local plastic deformations distal the first portion, and a third portion abutting the gripping cap distal the second portion, wherein the first portion, second portion, and third portion are each mounted inside the gripping cap, wherein the second portion defines at least one groove around an outer circumference of the outer surface of the assembly insert, said groove being formed by said local plastic deformations.

2. The applicator for applying the product according to claim 1, wherein the flexible portion of the applicator member is fastened in the assembly insert by local plastic deformation of said insert by crimping.

3. The applicator for applying the product according to claim 1, wherein the assembly insert is provided with a housing, inside which the flexible portion of the applicator member is mounted and fastened.

4. The applicator for applying the product according to claim 1, wherein the flexible portion of the applicator member is made of flexible material and the assembly insert is made of rigid material.

5. The applicator for applying the product according to claim 1, wherein the Shore D hardness of the assembly insert is greater than the Shore D hardness of the flexible portion of the applicator member by at least 20 units of hardness.

6. The applicator for applying the product according to claim 1, wherein the gripping cap, the assembly insert and the applicator member are designed such that a diameter D of said cap is between 8 mm and 12 mm and an axial length L between said cap and the applicator member is between 10 mm and 25 mm, with in particular an L/D ratio of between 0.83 and 3.13.

7. The applicator for applying the product according to claim 1, wherein the assembly insert comprises at least one thread that is able to allow said applicator to be fastened to the container.

8. The applicator for applying the product according to claim 1, wherein the assembly insert comprises at least one retaining member that engages with at least one complementary retaining member of the gripping cap in order to axially secure said cap relative to the assembly insert.

9. The applicator for applying the product according to claim 1, wherein the applicator member comprises a stem that forms said flexible portion and a plurality of application elements that are carried by the stem and each define a product application surface.

10. The applicator for applying the product of claim 1, wherein a cross section of the at least one groove is a rounded rectangle.

11. The applicator for applying the product of claim 1, wherein the at least one groove extends circumferentially around the outer surface of the assembly insert.

12. The applicator for applying the product of claim 1, wherein the first portion comprises a proximal fastening portion.

13. The applicator for applying the product of claim 1, wherein the third portion comprises a bulge.

14. A device for packaging and applying a product, in particular a cosmetic product, comprising a storage container, for storing said product, a neck of the storage container, and an applicator according to claim 1 that is mounted in a removable manner between a closing position in which the assembly insert seals off the storage container and the applicator member is situated inside said storage container, being at least partially in contact with the product contained therein, and an application position in which the applicator is separated from said storage container.

15. The device for packaging and applying the product according to claim 14, wherein the storage container comprises a body and a collar which is fastened to the neck of the storage container and on which the assembly insert of the applicator is mounted in a removable manner.

16. The device for packaging and applying the product according to claim 15, wherein the collar comprises an internal skirt, inside which the assembly insert and an end portion of the gripping cap of the applicator are fitted.

17. The device for packaging and applying the product according to claim 16, wherein the internal skirt of the collar is provided with a fastening portion comprising at least one thread engaged with a thread of the assembly insert, and with a sealing portion in sealing contact with said insert.

18. The device for packaging and applying the product according to claim 14, wherein the assembly insert of the applicator is fastened to the neck of the storage container.

19. An applicator for applying a product, comprising a gripping cap, an applicator member that is provided with at least one application surface for said product and comprises a flexible portion, and a rigid assembly insert that is mounted at least partially inside the gripping cap and is secured to said cap, wherein the assembly insert comprises at least one fastening element that is able to allow said applicator to be fastened to a container, wherein the gripping cap comprises an upper end wall and a peripheral wall extending from the upper end wall, wherein the flexible portion of the applicator member protrudes axially out of the assembly insert and is fastened in the assembly insert in a region of said insert that is mounted inside the gripping cap, wherein the flexible portion of the applicator member is fastened in the assembly insert by local plastic deformations of said insert which extend radially against the flexible portion of the applicator member, wherein said local plastic deformations are visible at the assembly insert and concealed by the gripping cap, wherein fastening regions between the assembly insert and the flexible portion of the applicator member are axially offset toward the upper end wall of the gripping cap with respect to the fastening element of the assembly insert, wherein the assembly insert comprises a first portion, a second portion comprising the local plastic deformations distal the first portion, and a third portion abutting the gripping cap distal the second portion, wherein the first portion, second portion, and third portion are each mounted inside the gripping cap, wherein the second portion defines at least one groove around an outer circumference of an outer surface of the assembly insert, said groove being formed by said local plastic deformations.

20. An applicator for applying a product, comprising a gripping cap, an applicator member that is provided with at least one application surface for said product and comprises a flexible portion, and a rigid assembly insert that is mounted at least partially inside the gripping cap and is secured to said cap, wherein the assembly insert comprises at least one fastening element that is able to allow said applicator to be fastened to a container, wherein the gripping cap is mounted on an outer surface of the assembly insert, wherein the flexible portion of the applicator member is fastened in the assembly insert in a region of said insert that is mounted inside the gripping cap, wherein the flexible portion of the applicator member is fastened in the assembly insert by local plastic deformations of the outer surface of said insert, wherein a radial space is formed between the gripping cap and each local plastic deformation of the outer surface of the assembly insert, wherein said local plastic deformations are visible at the outer surface of the assembly insert and concealed by the gripping cap, wherein the assembly insert comprises a first portion, a second portion comprising the local plastic deformations distal the first portion, and a third portion abutting the gripping cap distal the second portion, wherein the first portion, second portion, and third portion are each mounted inside the gripping cap, wherein the second portion defines at least one groove around an outer circumference of the outer surface of the assembly insert, said groove being formed by said local plastic deformations.

* * * * *